United States Patent [19]

Laribee

[11] 4,181,293

[45] Jan. 1, 1980

[54] HANDRAIL SUPPORT HARDWARE

[75] Inventor: Ralph S. Laribee, Plantsville, Conn.

[73] Assignee: Leigh Products, Inc., Coopersville, Mich.

[21] Appl. No.: 835,485

[22] Filed: Sep. 22, 1977

[51] Int. Cl.[2] ..... E04F 11/18

[52] U.S. Cl. ..... 256/67; 403/108; 403/287

[58] Field of Search ..... 256/65, 67, 59, 68, 256/69, 22, 21; 403/4, 3, 393, 108, 287; 52/235, 378

[56] References Cited

U.S. PATENT DOCUMENTS

| | | | |
|---|---|---|---|
| 1,056,576 | 3/1913 | Olson | 403/393 |
| 2,590,929 | 4/1952 | Bush | 256/21 |
| 4,070,835 | 1/1978 | Reverend et al. | 52/235 |

FOREIGN PATENT DOCUMENTS

| | | | |
|---|---|---|---|
| 2437073 | 2/1976 | Fed. Rep. of Germany | 52/235 |
| 2439267 | 2/1976 | Fed. Rep. of Germany | 52/235 |

*Primary Examiner*—Werner H. Schroeder
*Attorney, Agent, or Firm*—DeLio and Montgomery

[57] ABSTRACT

A bracket arrangement for mounting a handrail onto a support at variable predetermined spacing therefrom.

2 Claims, 5 Drawing Figures

HANDRAIL SUPPORT HARDWARE

BACKGROUND OF THE INVENTION

1. Field of the Invention

This invention relates generally to the field of handrails and mounting hardware therefor.

2. Description of the Prior Art

Generally handrails are mounted onto supports such as walls or posts through mounting brackets. The brackets serve the dual function of supporting the handrail and providing a selected spacing from the support.

In many cases the support surface may not be planar, in which case the end of the mounting brackets which attach to the handrail may not lie in a straight line. This may present some difficulty in using the brackets or may require bending the handrail to accommodate the non-alignment of the bracket mounts. This problem may also be present where the supports are separate posts or the like, which are unlikely to be perfectly aligned.

Furthermore, building codes in different jurisdictions require different clearances or spacings between the support and the handrail. The building codes in different jurisdictions require minimum clearances which typically may be one and one-half inches to three inches. Therefore, different brackets may have to be used in different areas.

SUMMARY OF THE INVENTION

It is therefore an object of this invention to provide a new and improved handrail support structure.

It is another object of the invention to provide handrail supporting brackets in which the spacing between the handrail and the support may be accurately adjusted, and the handrail quickly fastened in place.

It is another object of the invention to provide a handrail and support brackets therefor capable of compensating for the non-planar character of the support surface and for the non-linear character of the handrail.

Briefly described, the invention in one form thereof provides a new and improved handrail and support brackets adapted to be mounted onto a support. The support bracket comprises two members, one member being attached to the support and the other member being attached to the handrail. Each member has an arm extending therefrom, which arms are fastened together. The arms may be fastened together anywhere therealong to provide adjustable spacing.

BRIEF DESCRIPTION OF THE DRAWINGS

The features of the invention which are believed to be novel are particularly pointed out and distinctly claimed in the concluding portion of this specification. The invention, however, both as to its operation and organization together with further objects and advantages thereof may best be appreciated by reference to the following detailed description taken in conjunction with the drawings wherein:

DETAILED DESCRIPTION OF THE PREFERRED EMBODIMENT

Figure 1:
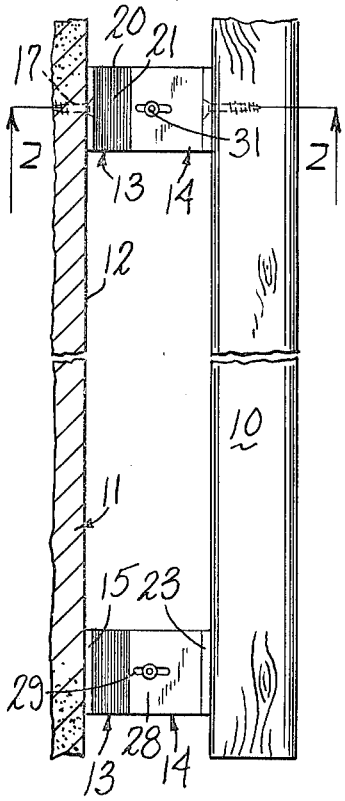
FIG. 1 is a plan view of the handrail, support and mounting brackets.
Figure 2:
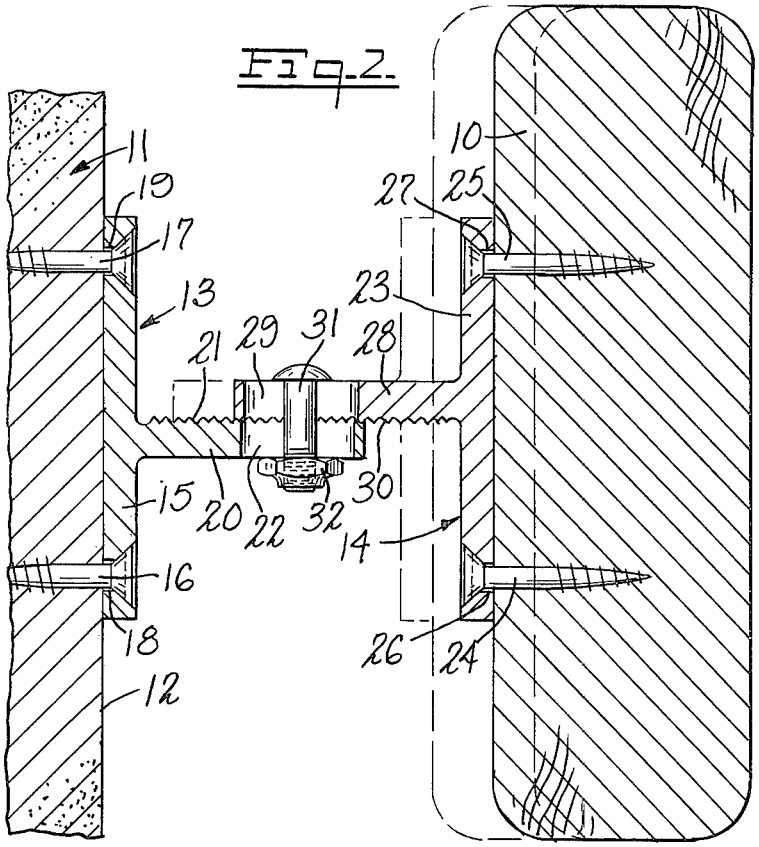
FIG. 2 is a sectional view taken in the plane through line 2—2 of FIG. 1.

With reference to FIGS. 1 and 2, the invention provides a means for mounting a handrail 10 to a support such as a wall 11. Handrail 10 is shown as being wooden and may for example be two inches by six inches with rounded edges. The handrail is mounted onto surface 12 through a support bracket 13 and a handrail bracket 14. Support bracket 13 comprises a mounting portion 15 secured to wall 11 by two screws or bolts 16 and 17 extending through apertures 18 and 19. Intermediate the ends of mounting portion 15 is a horizontally extending arm 20 having an upper surface 21 which is preferably serrated. A slot 22 elongated in a direction transverse to support 11 is defined through arm 20.

Bracket 14 comprises a mounting portion 23 which is secured to handrail 10 by means of screws 24 and 25 extending through apertures 26 and 27 in portion 23. Arm 28 extends from mounting portion 23 intermediate the ends thereof. Arm 28 has a slot 29 defined therein elongated in the direction perpendicular to the handrail. Arm 28 is also preferably serrated on surface 30, the pattern of which serrations matches the serration pattern of surface 21.

Arms 20 and 28 are secured together by means of a fastening device shown as bolt 31 and nut 32. Serrated surface 21 is situated proximate surface 30 so that the serrations intermesh.

Figure 3:
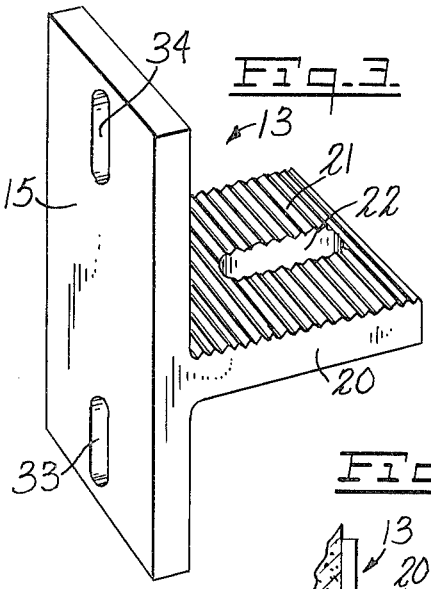
FIG. 3 is an isometric view of a modification of one of the brackets shown in FIGS. 1 and 2.

As shown in FIG. 3, the mounting holes in mounting portion 15 may constitute slots 33 and 34 elongated in the direction transverse to arm 20. This permits vertical adjustment of bracket 13 on support 11.

Figure 4:
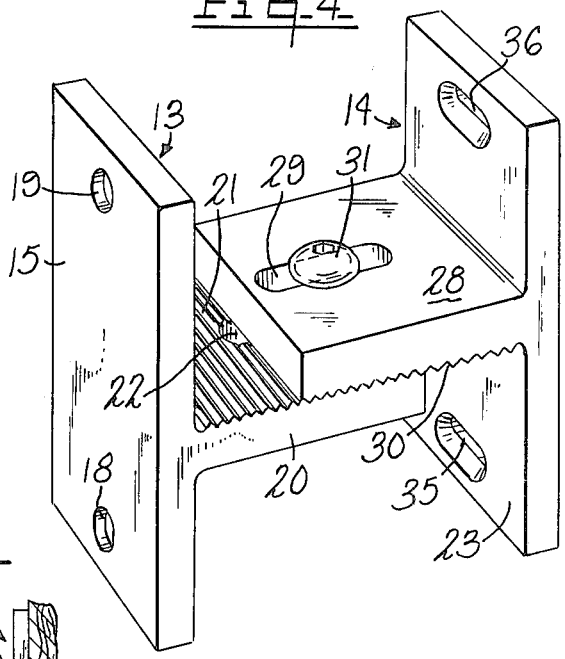
FIG. 4 is an isometric view of two bracket members fastened together according to the invention.
Figure 5:
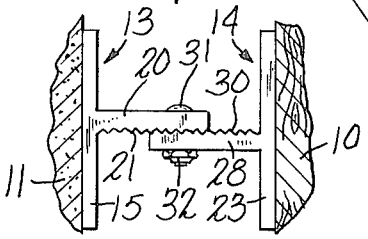
FIG. 5 is an alternate way of mounting the bracket.

With reference to FIG. 4, the mounting holes in mounting portion 21 of bracket 14 may constitute slots 35 and 36 elongated in the direction parallel to the handrail. This permits horizontal adjustment for precise positioning of handrail 10 thereon.

In mounting brackets 13 and 14 handrail 10, support brackets 13 are first located at a proper height and selected spacing along wall 11. Brackets 13 are then fastened to wall 11 by means of screws, bolts, or such other fastening degices as may be dictated by the material of the wall or by accepted construction techniques. The handrail brackets 14 are then mounted to the handrail. Brackets 14 are first fastened tightly to the handrail and then loosened slightly to permit lateral adjustment. Arms 28 are then placed on top of arms 20, with the handrail spaced a predetermined distance from the wall, and the serrated faces 21 and 30 facing each other. The arms are then fastened together through fastening devices such as bolt 31 and nut 32. At this point, any lateral spacing adjustment as may be necessary is made in bracket 14 by means of the elongated slots 22 and 29. In this final assembly, measurement is made for proper spacing along the length of handrail 10 as required. Screws 24 and 25 are then tightened with an angle screwdriver. The serrations in surfaces 21 and 30 positively space the handrail from the wall.

Brackets 13 and 14 may be situated with arms 20 and 28 horizontally, or parallel to the elongated direction of the handrail, or in any other orientation. The preferred orientation, however, is with arms 20 and 28 horizontal.

As shown in FIG, 5, the brackets 13 and 14 may be mounted so that serrated surface 21 faces downwardly and surface 30 faces upwardly. If mounted in this orientation, arm 20 provides less vertical support, the vertical support coming from fastening devices 31 and 32. This orientation may, however, be more esthetically pleasing because the serrated surfaces are less likely to be visible; handrail 10 would effectively block the view of serrated surface 30 in many instances.

The serrated surfaces 21 and 30 are shown as extending unidirectionally parallel to respective mounting members 15 and 23. The serrations may, however, be of any pattern as long as the patterns match each other and intermesh satisfactorily. For example, herringbone or wave patterns may effectively be used to provide effective locking in the lateral direction as well as in the direction of the spacing between the handrail and the wall.

It should be recognized that it is also possible to utilize the bracket members 13 and 14 in connection with the mounting of handrails 10 on such members as posts or any other support device. The example of mounting on a wall is for purposes of illustration only. In the event brackets 13 and 14 are to be mounted on non-planar support surfaces or non-planar handrails 10, the appropriate bracket mounting member 15 or 23 may be contoured so as to meet with or follow the contour of the support surface or handrail.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. In combination with a handrail and a vertical support therefor, a handrail support assembly comprising, a pair of essentially identical bracket members, one of said members adapted to be mounted to said support and the other to said handrail, each of said bracket members having a mounting plate and an arm extending outwardly from said mounting plate intermediate the ends thereof, said arms having mating serrations defined thereon in the direction of the handrails, elongated slots in said arms perpendicular to said serrations adapted to receive a clamping means therethrough whereby the arms are positioned to uniformly predetermine the distance of the handrail from the support and the arms are held in compressive engagement with said mating serrations intermeshed, and means in each mounting plate on either side of the arm for securing each plate to one of the handrail and the support whereby the mounting plate is secured on either side of the arm, said means including slots elongated in the direction of the handrail in at least one of said members.

2. The combination of claim 1 wherein the member not having slots elongated in the direction of the handrail has slots elongated in a direction perpendicular to the direction of the handrail.

* * * * *